US010500844B2

(12) United States Patent
Watanabe et al.

(10) Patent No.: US 10,500,844 B2
(45) Date of Patent: Dec. 10, 2019

(54) WAVEFORM GENERATING DEVICE AND INK JET RECORDING APPARATUS

(71) Applicant: TOSHIBA TEC KABUSHIKI KAISHA, Tokyo (JP)

(72) Inventors: Hiroyuki Watanabe, Ichikawa Chiba (JP); Jun Takamura, Mishima Shizuoka (JP); Noboru Nitta, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/057,218

(22) Filed: Aug. 7, 2018

(65) Prior Publication Data

US 2019/0091999 A1 Mar. 28, 2019

(30) Foreign Application Priority Data

Sep. 22, 2017 (JP) ..... 2017-181959

(51) Int. Cl.
*B41J 2/045* (2006.01)

(52) U.S. Cl.
CPC ..... *B41J 2/0452* (2013.01); *B41J 2/0459* (2013.01); *B41J 2/04573* (2013.01); *B41J 2/04581* (2013.01); *B41J 2/04588* (2013.01)

(58) Field of Classification Search
CPC ..... B41J 2/04588
See application file for complete search history.

(56) References Cited

U.S. PATENT DOCUMENTS

| | | | | |
|---|---|---|---|---|
| 9,205,647 | B2 | 12/2015 | Ichikawa | |
| 2011/0279502 | A1 | 11/2011 | Kaneko et al. | |
| 2015/0138265 | A1* | 5/2015 | Ito | B41J 2/04581 347/10 |
| 2016/0167378 | A1 | 6/2016 | Kimura et al. | |
| 2017/0157920 | A1* | 6/2017 | Taniyama | B41J 2/04541 |
| 2017/0165964 | A1* | 6/2017 | Misawa | B41J 2/04541 |

FOREIGN PATENT DOCUMENTS

| | | | |
|---|---|---|---|
| EP | 3031609 | A1 | 6/2016 |
| JP | 5871851 | B2 | 3/2016 |
| JP | 2018161749 | A | 10/2018 |

OTHER PUBLICATIONS

Extended European Search Report dated Jan. 29, 2019, mailed in counterpart European Application No. 18193510.7, 8 pages.

* cited by examiner

*Primary Examiner* — Julian D Huffman
(74) *Attorney, Agent, or Firm* — Kim & Stewart LLP

(57) ABSTRACT

According to one embodiment, a waveform generating device includes a head driver configured to apply a driving signal to an actuator to discharge ink from a pressure chamber connected to a nozzle, the driving signal including a first portion for reducing an ink pressure in the pressure chamber and a second portion for increasing the ink pressure in the pressure chamber. The second portion is increased in potential by a first potential increase when ink pressure in the pressure chamber is at a maxima and the second portion is further increased in potential by a second potential increase when the ink pressure of the pressure chamber is at a negative value after the first potential increase.

20 Claims, 10 Drawing Sheets

WAVEFORM GENERATING DEVICE AND INK JET RECORDING APPARATUS

CROSS-REFERENCE TO RELATED APPLICATION

This application is based upon and claims the benefit of priority from Japanese Patent Application No. 2017-181959, filed Sep. 22, 2017, the entire contents of which are incorporated herein by reference.

FIELD

Embodiments described herein relate generally to a waveform generating device and an ink jet recording apparatus.

BACKGROUND

Inkjet printers eject ink droplets from a nozzle of an ink jet head. Ink jet heads use various methods of discharging ink, including the use of a piezoelectric element. An inkjet head using a piezoelectric element discharges ink when a driving signal is applied to the piezoelectric element so as to deform the piezoelectric element. For a reduction of power consumption or the like, it is desired that only a low voltage of the driving signal (hereinafter, referred to as "driving voltage") is required.

DETAILED DESCRIPTION

In general, according to one embodiment, a waveform generating device includes a head driver configured to apply a driving signal to an actuator to discharge ink from a pressure chamber connected to a nozzle, the driving signal including a first portion for reducing an ink pressure in the pressure chamber and a second portion for increasing the ink pressure in the pressure chamber. The second portion is increased in potential by a first potential increase when ink pressure in the pressure chamber is at a maxima and the second portion is further increased in potential by a second potential increase when the ink pressure of the pressure chamber is at a negative value after the first potential increase.

Hereinafter, the ink jet recording apparatus according to example embodiments will be described with reference to drawings. It should be noted that the drawings are schematic and are drawn with exaggeration and omissions for purposes of explanatory convenience. In general, components are not drawn to scale. In addition, the number of components, the dimensional ratio between different components, or the like, does not necessarily match between different drawings or to actual devices.

Figure 1:
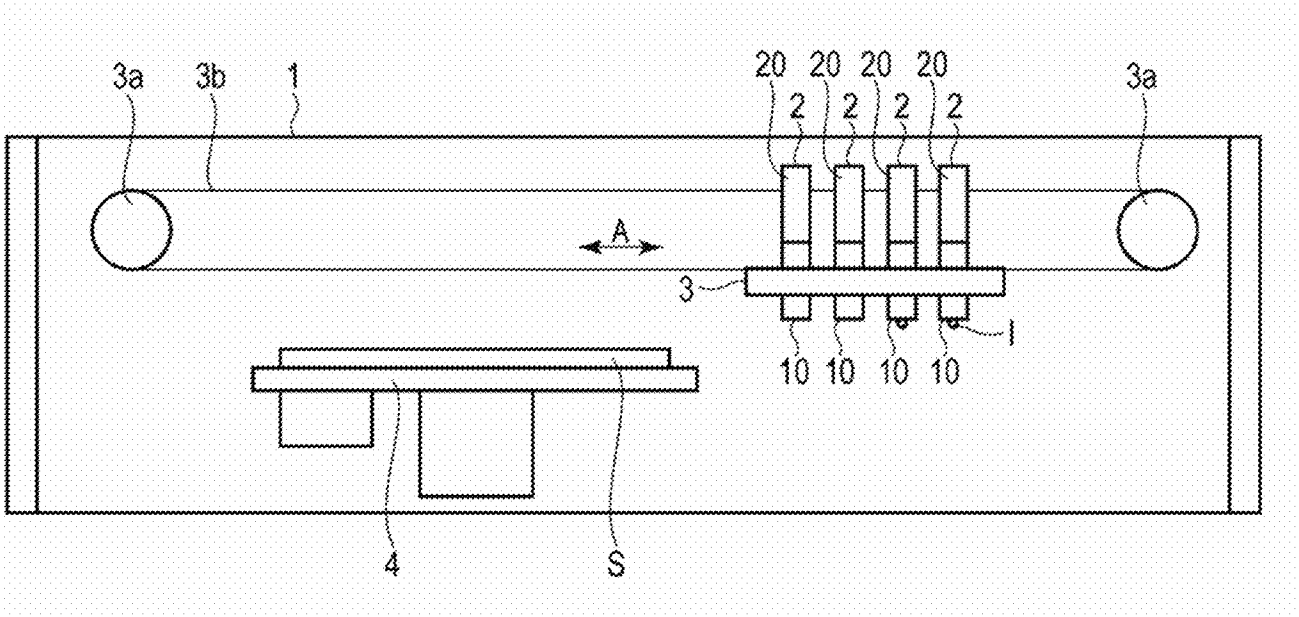
FIG. 1 is a perspective view illustrating an example of a configuration of an ink jet recording apparatus according to an embodiment.

FIG. 1 is a perspective view illustrating an example of a configuration of an ink jet recording apparatus 1 of the embodiment.

The ink jet recording apparatus 1 forms an image on image forming medium S or the like using recording material such as ink. As an example, the ink jet recording apparatus 1 includes fluid discharging units 2, a head supporting mechanism 3 movably supporting the fluid discharging units 2, and a medium supporting mechanism 4 movably supporting the image forming medium S. The image forming medium S is, for example, a sheet of paper, fabric, resin, or the like.

As illustrated in FIG. 1, the fluid discharging units 2 are supported by the head supporting mechanism 3 and arranged in a predetermined direction. The head supporting mechanism 3 is attached to a loop-shaped belt 3*b* suspended on a pair of roller 3*a*. The ink jet recording apparatus 1 is capable of moving the head supporting mechanism 3 in a main scanning direction A orthogonal to a transporting direction of the image forming medium S by rotating the roller 3*a*. The fluid discharging units 2 integrally includes an inkjet head 10 and a circulation device 20. The fluid discharging unit 2 performs an operation of discharging ink I, for example, fluid, from the ink jet head 10. The ink jet recording apparatus 1 may form a predetermined image on the image forming medium S by discharging an ink while reciprocating the head supporting mechanism 3 in the main scanning direction A. Alternatively, the ink jet recording apparatus 1 may form an image without moving the head supporting mechanism 3. In this case, the roller 3*a* and the loop-shaped belt 3*b* may not be provided and the head supporting mechanism 3 is fixed to, for example, a case of the ink jet recording apparatus 1.

The fluid discharging units 2 each discharge, for example, four colors ink corresponding to cyan, magenta, yellow, and black (CMYK), that is, cyan ink, magenta ink, yellow ink, and black ink.

Hereinafter, the inkjet head 10 will be described based on FIGS. 2 to 4. In the example embodiments described herein, the ink jet head 10 is a circulation type side shooter type ink jet head in a share mode and share wall manner. However, the types of the ink jet head 10 are not limited.

Figure 2:
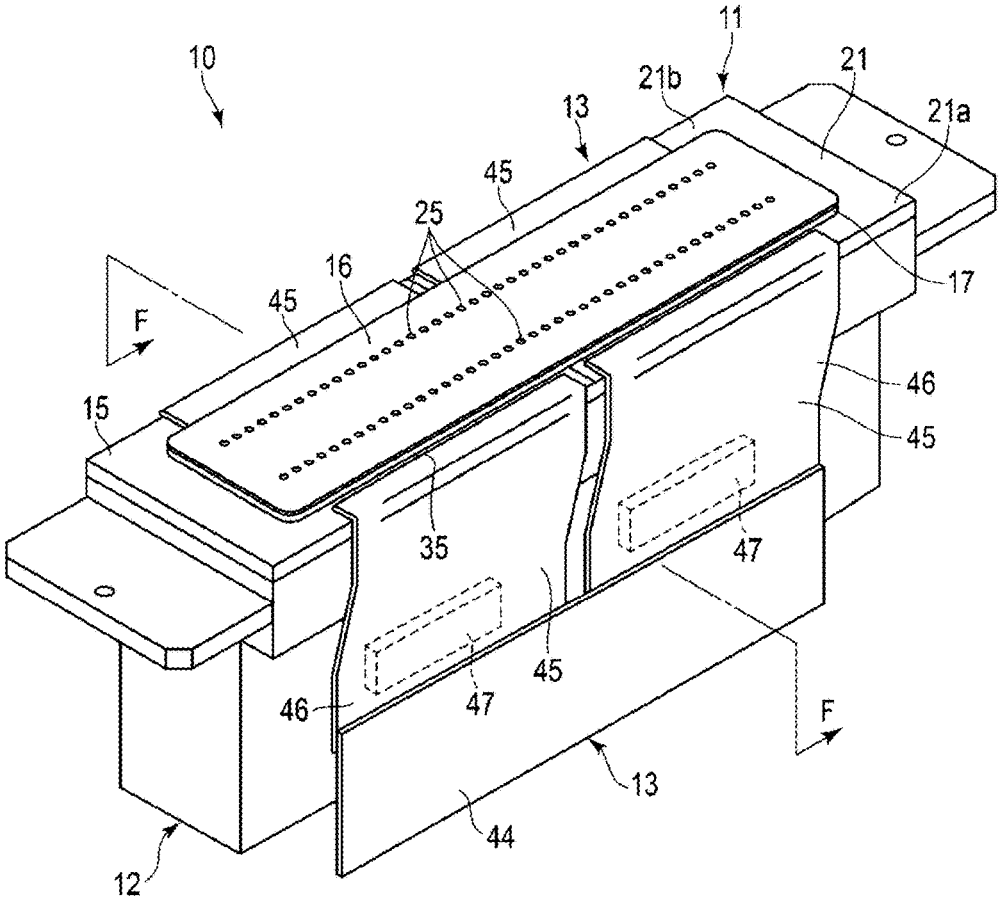
FIG. 2 is a schematic perspective view of a fluid discharging head illustrated in FIG. 1.

FIG. 2 is a perspective view illustrating an example of a configuration of the ink jet head 10. FIG. 3 is an exploded perspective view illustrating the example of the configuration of the inkjet head 10. FIG. 4 is a cross-sectional view taken along IV-IV line in FIG. 2.

The ink jet head 10 is mounted in the ink jet recording apparatus 1 and is connected to an ink tank through a component such as a tube. The ink jet head 10 includes a head body 11, a main body 12, and a pair of circuit substrates 13. In this context, the ink jet head 10 is a waveform generating device.

The head body 11 discharges ink. The head body 11 is attached to the main body 12. The main body 12 includes a manifold forming a part of an ink flow passage between the head body 11 and the ink tank or other elements inside of the ink jet recording apparatus 1. The circuit substrates 13 are attached to the head body 11.

Figure 3:
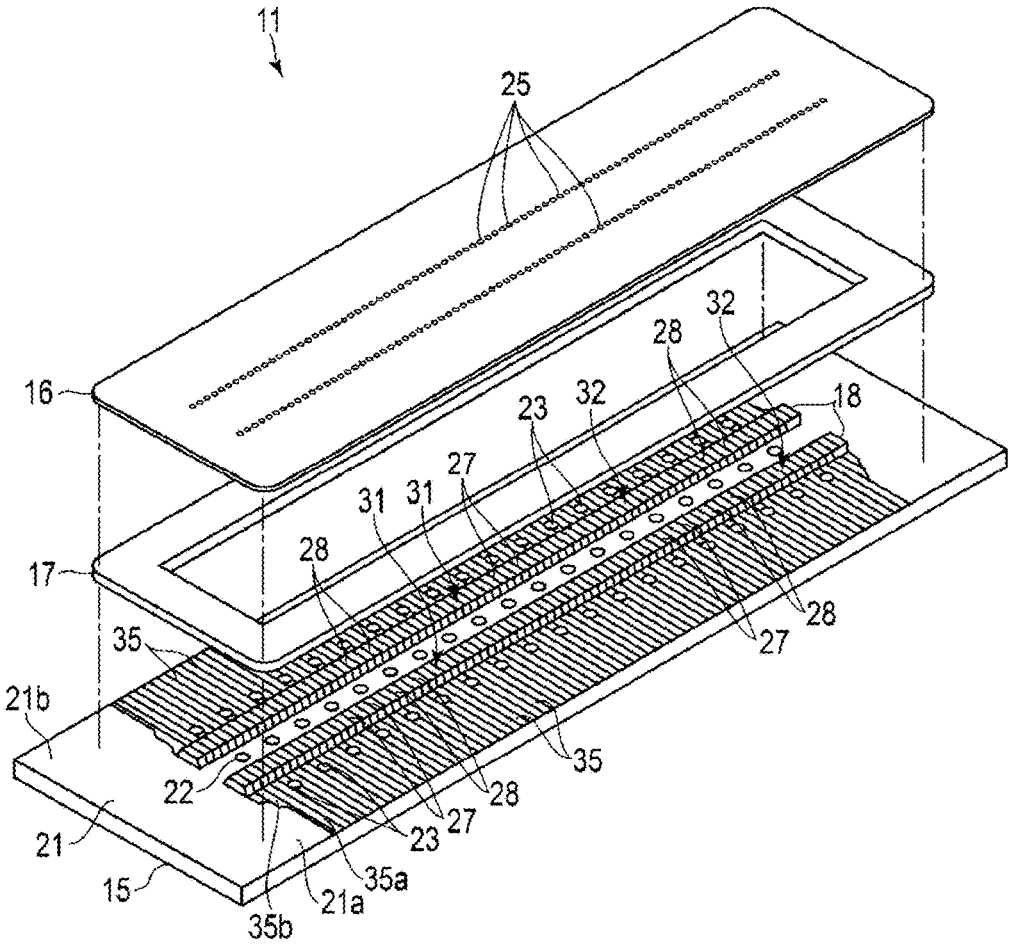
FIG. 3 is an exploded schematic perspective view of a fluid discharging head.
Figure 4:
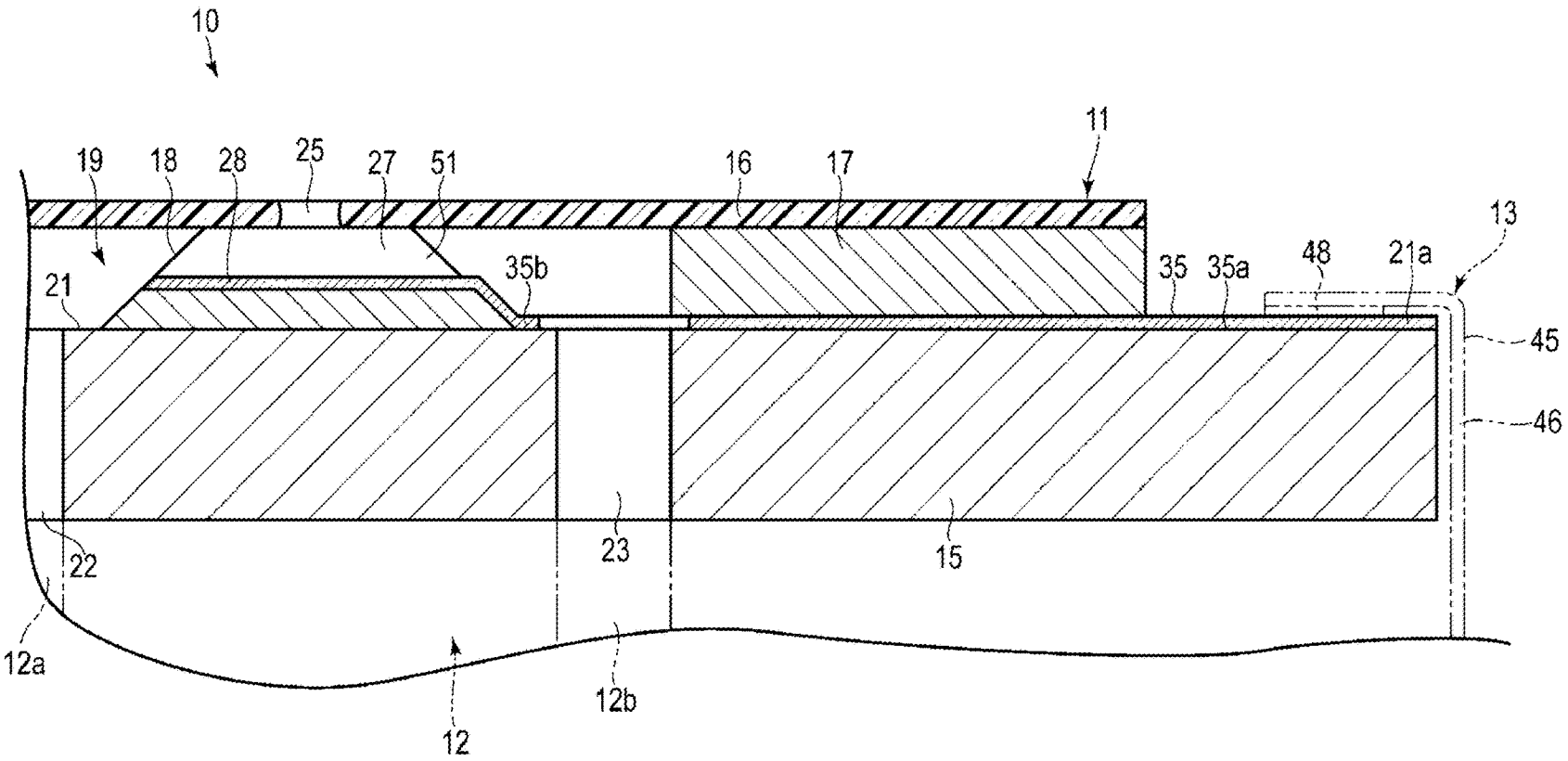
FIG. 4 is a cross-sectional perspective view taken along F-F line of FIG. 2.

The head body 11 includes a base plate 15, a nozzle plate 16, a frame 17, and a pair of driving elements 18 illustrated in FIGS. 3 and 4. Inside of the head body 11, as illustrated in FIG. 4, an ink chamber 19 to which ink is supplied is formed.

The base plate 15 is formed in a rectangular plate shape using ceramics such as alumina as illustrated in FIG. 3. The base plate 15 includes a flat mounting surface 21. The base plate 15 includes supplying holes 22 and discharging holes 23 opening to the mounting surface 21.

The supplying holes 22 are provided in a line in a longitudinal direction of the base plate 15 at the center of the base plate 15. The supplying holes 22 communicate with an ink supplying portion 12*a* of the manifold of the main body 12. The supplying holes 22 are connected to the ink tank inside the circulation device 20 through the ink supplying portion 12*a*. Ink in the ink tank is supplied to the ink chamber 19 through the ink supplying portion and the supplying holes 22.

The discharging holes 23 are arranged in two rows so as to sandwich the supplying holes 22 between a first row and a second row thereof. The discharging holes 23 communicate with an ink discharging unit 12*b* of the manifold of the main body 12. The discharging holes 23 are connected to the ink tank inside the circulation device 20 through the ink discharging unit 12*b*. The ink in the ink chamber 19 is recovered to the ink tank through the ink discharging unit 12*b* and the discharging holes 23. In this manner, the ink is circulated between the ink tank and the ink chamber 19.

The nozzle plate 16 is formed of, for example, a rectangular shaped film made of polyimide, a front surface of which is having fluid-repellent. The nozzle plate 16 faces a mounting surface 21 of the base plate 15. Nozzles 25 are provided on the nozzle plate 16. The nozzles 25 are arranged in two rows along a longitudinal direction of the nozzle plate 16.

The frame 17 is formed of, for example, nickel alloy in a rectangular frame shape. The frame 17 is interposed between the mounting surface 21 of the base plate 15 and the nozzle plate 16. The frame 17 is respectively attached to the mounting surface 21 and the nozzle plate 16. That is, the nozzle plate 16 is attached to the base plate 15 through the frame 17. The ink chamber 19 is surrounded by the base plate 15, the nozzle plate 16, and the frame 17 as illustrated in FIG. 4.

The driving element 18 is formed by, for example, two plate shaped piezoelectric bodies made of lead zirconate titanate (PZT). The two piezoelectric bodies are adhered to each other so that a polarization direction thereof is opposite one another in a thickness direction thereof.

The pair of driving elements 18 is adhered to the mounting surface 21 of the base plate 15 as illustrated in FIG. 3. The pair of driving elements 18 in the ink chamber 19 parallel to the nozzles 25, as illustrated in FIG. 4. The cross-section of the driving element 18 is formed in a trapezoidal shape. The apex of the driving element 18 is adhered to the nozzle plate 16.

Grooves 27 are provided on the driving element 18. The grooves 27 respectively extend in a direction intersecting with a longitudinal direction of the driving element 18 and are arranged in the longitudinal direction of the driving element 18. The grooves 27 face the nozzles 25 of the nozzle plate 16. In the driving element 18 of the embodiment, as illustrated in FIG. 4, pressure chambers 51 serve as a driving flow passage for discharging ink to the grooves 27.

An electrode 28 is provided on each of the grooves 27. The electrode 28 is formed by, for example, photoresist-etching a nickel thin film. The electrode 28 covers an inner surface of the grooves 27.

As illustrated in FIG. 3, wiring patterns 35 are provided from the mounting surface 21 of the base plate 15 over the driving element 18. These wiring patterns 35 are formed by, for example, photoresist-etching a nickel thin film.

The wiring patterns 35 respectively extend from one side end portion 21*a* and another side end portion 21*b* of the mounting surface 21. The side end portions 21*a* and 21*b* include not only edges of the mounting surface 21 but also peripheral regions thereof. Therefore, the wiring patterns 35 may be provided inside the edge of the mounting surface 21.

In the example embodiments described hereinafter, the wiring pattern 35 extend from one side end portion 21*a*. A basic configuration of the wiring patterns 35 of another side end portion 21*b* is the same as that of the wiring patterns 35 of the one side end portion 21*a*.

The wiring pattern 35 includes a first part 35*a* and a second part 35*b* as illustrated in FIGS. 3 and 4. The first part 35*a* of the wiring pattern 35 is a part extending linearly from the side end portion 21*a* on the mounting surface 21 toward the driving element 18. The first parts 35*a* extend in parallel to another. The second part 35*b* of the wiring pattern 35 is a part extending over an end portion of the first part 35*a* and the electrode 28. The second parts 35*b* are respectively and electrically connected to the electrodes 28.

In one driving element 18, some electrodes 28 of the electrodes 28 constitute a first electrode group 31. The other electrodes 28 of the electrodes 28 constitute a second electrode group 32.

The first electrode group 31 and the second electrode group 32 are divided by the center of the driving element 18 in the longitudinal direction as a boundary. The second electrode group 32 is adjacent to the first electrode group 31. The first and the second electrode groups 31 and 32 respectively include, for example, 159 electrodes 28.

As illustrated in FIG. 2, each of the pair of circuit substrates 13 includes a substrate main body 44 and a pair of film carrier packages (FCP) 45. The FCP is also referred to as a tape carrier package (TCP).

The substrate main body 44 is a rigid printer wiring plate formed in a rectangular shape. Various electronic components and connectors are mounted in the substrate main body 44. Each of a pair of FCPs 45 is attached to the substrate main body 44.

Each of the pair of FCPs 45 includes a film 46 made of a flexible resin on which wirings are formed and a head driving circuit 47 connected to the wirings. The film 46 is formed by tape automated bonding (TAB). The head driving circuit 47 is an integrated circuit (IC) for applying a voltage to the electrode 28. The head driving circuit 47 is fixed to the film 46 using resin.

An end portion of one FCP 45 is thermocompression-bonded to the first part 35*a* of the wiring pattern 35 by an anisotropic conductive film (ACF) 48. Accordingly, the wirings of the FCPs 45 are electrically connected to the wiring patterns 35.

When the FCPs 45 are connected to the wiring patterns 35, the head driving circuit 47 is electrically connected to the electrode 28 through the wiring of the FCP 45. The head driving circuit 47 applies a voltage to the electrode 28 through the wiring of the film 46.

If the head driving circuit 47 applies a voltage to the electrode 28, the driving element 18 is shear mode-deformed, and thus a volume of the pressure chamber 51 in which the electrode 28 is provided is increased or decreased.

Accordingly, a pressure of ink in the pressure chamber 51 is changed, and the ink is discharged from the nozzle 25. The driving element 18 separating the pressure chamber 51 becomes an actuator for applying pressure vibration into the pressure chamber 51.

The circulation device 20 illustrated in FIG. 1 is integrally connected to an upper portion of the ink jet head 10 by a connecting component made of a metal or the like. The circulation device 20 includes a predetermined circulation passage which is configured to be capable of circulating fluid to be passed through the ink tank and the inkjet head 10. The circulation device 20 includes a pump for circulating fluid. The fluid is supplied into the ink jet head 10 through the ink supplying unit from the circulation device 20 by moving the pump and is sent to the circulation device 20 from the inside of the ink jet head 10 through the ink discharging unit after being passed through a predetermined flow passage.

The circulation device 20 supplies the fluid to a circulation passage from a cartridge which is provided to the outside of the circulation passage as a supply tank.

Figure 5:
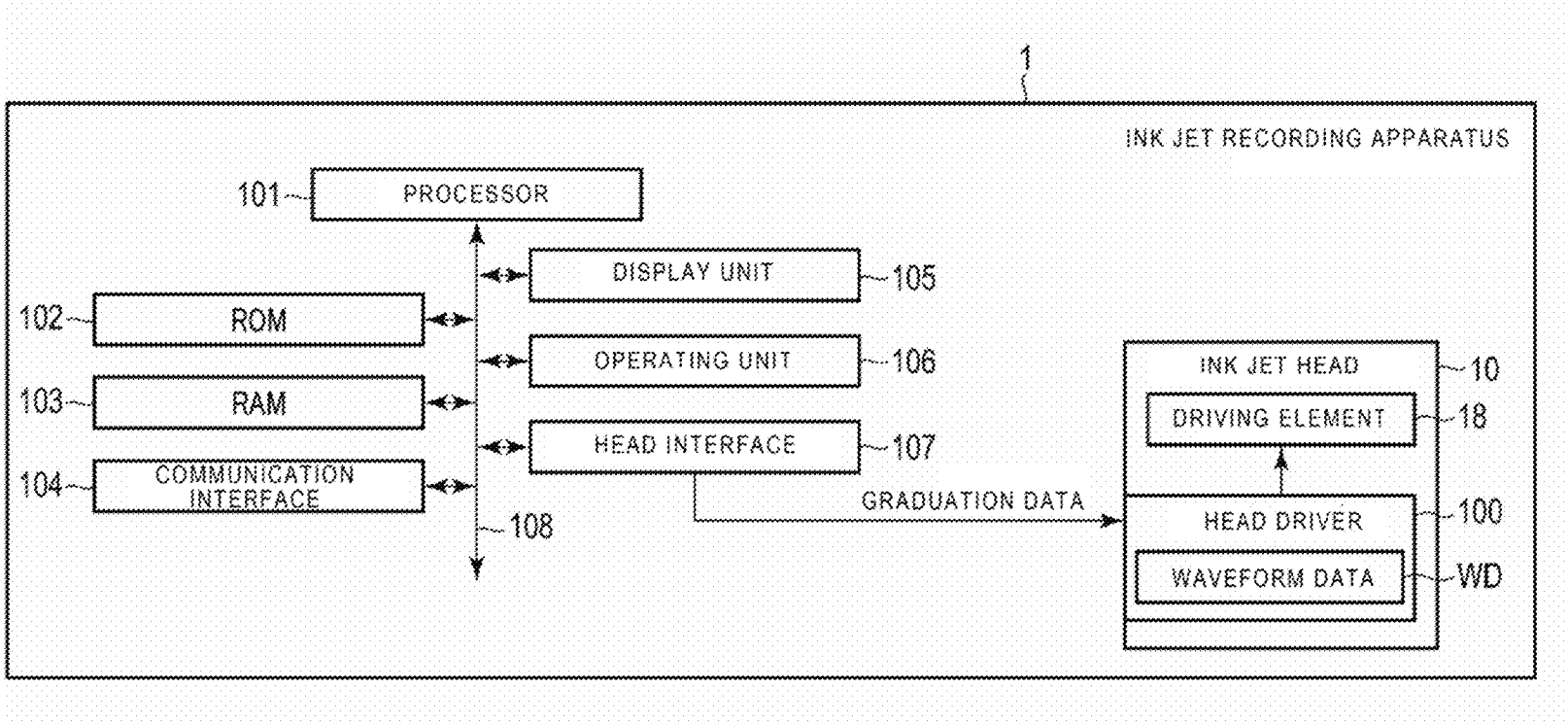
FIG. 5 is a block diagram illustrating a portion of a circuit configuration of the ink jet recording apparatus illustrated in FIG. 1.

A main part circuit configuration of the ink jet recording apparatus 1 will be described. FIG. 5 is a block diagram illustrating an example of a main part circuit configuration of the ink jet recording apparatus 1 according to the embodiment.

The ink jet recording apparatus 1 includes a processor 101, a read-only memory (ROM) 102, a random-access memory (RAM) 103, a communication interface 104, a display unit 105, an operating unit 106, a head interface 107, a bus 108, and the ink jet head 10.

The processor 101 corresponds to a central part of a computer which performs processes and control required for operating the ink jet recording apparatus 1. The processor 101 controls each unit, which realizes various functions of the ink jet recording apparatus 1 based on system software, application software, firmware, or the like stored in the ROM 102. The processor 101 is, for example, a central processing unit (CPU), a micro processing unit (MPU), a system on a chip (SoC), a digital signal processor (DSP), or a graphics processing unit (GPU). The processor 101 can be a combination of these units described above.

The ROM 102 is part of the computer including the processor 101 and is nonvolatile memory only used for reading data. The ROM 102 stores the programs described above. The ROM 102 stores data, various setting values, or the like for performing various processes by the processor 101.

The RAM 103 is part of the computer including the processor 101 and is a memory for reading and writing data. The RAM 103 stores data which is temporarily used for performing various processes by the processor 101 and is used as a so-called work area or the like.

The communication interface 104 is an interface used for the ink jet recording apparatus 1 in order to communicate with a host computer or the like through a network or a communication cable.

The display unit 105 displays a screen for notifying various information items to an operator of the ink jet recording apparatus 1. The display unit 105 is a display such as a liquid crystal display or an organic electro-luminescence (EL) display.

The operating unit 106 receives input from the operator of the ink jet recording apparatus 1. The operating unit 106 is, for example, a keyboard, a keypad, a touch pad, or a mouse. As the operating unit 106, a touch pad disposed to be overlapped with a display panel of the display unit 105 may also be used. That is, a display panel including a touch panel can be used as the display unit 105, and the touch panel can be used as the operating unit 106.

The head interface 107 is provided for the processor 101 to communicate with the ink jet head 10. The head interface 107 transmits gradation data or the like to the ink jet head 10 under control of the processor 101.

The bus 108 includes a control bus, an address bus, a data bus, and the like, and transfers a signal being received and transmitted each unit of the ink jet recording apparatus 1.

The inkjet head 10 includes a head driver 100. The head driver 100 is a driving circuit for operating the ink jet head 10. The head driver 100 is, for example, a line driver for converting and amplifying signals to drive a load such as a transmission line. The head driver 100 stores waveform data WD.

The head driver 100 repeatedly generates a single driving signal based on the waveform data WD. The head driver 100 controls the frequency of fluid droplet discharges to a pixel on the image forming medium S based on image gradation data. Whenever the driving signal is applied, one shot of ink (also referred to as a "main fluid droplet") is discharged from the nozzle 25. Therefore, contrasting density in images formed the ink jet recording apparatus 1 is determined by how many shots of ink are discharged to the image pixels. That is, as a more ink is discharged to a pixel, the pixel becomes darker.

The head driver 100 is an example of the waveform generating device. The head driver 100 is operated as a generating unit by generating the driving signal.

The head driver 100 may be transferred with the waveform data WD pre-stored thereon. However, the head driver 100 may also be transferred without the waveform data WD being pre-stored thereon. The head driver 100 may be transferred with other waveform data stored thereon. The waveform data WD may be transferred separately from the head driver 100 and may then be written in the head driver 100 under operation by an administrator, a service person, or the like. Transferring of the waveform data WD can be performed by use of a removable storage medium such as a magnetic disk, a magneto-optic disk, an optical disk, or a semiconductor memory storing the waveform data WD thereon, or the waveform data WD can be downloaded through a network or the like.

When the driving signal is applied, the driving element 18, which is a piezoelectric body, is shear mode-deformed. Due to the deformation, a volume of the pressure chamber 51 is changed.

The pressure chamber 51 when a potential of the driving signal is zero becomes in a normal state. When the potential of the driving signal is positive, the pressure chamber 51 contracts so that the volume of the pressure chamber 51 is reduced compared to the normal state. When the potential of the driving signal is negative, the pressure chamber 51 expands so that the volume of the pressure chamber 51 is increased compared to the normal state. According to such a volume change of the pressure chamber 51, a pressure of the ink inside the pressure chamber 51 is changed. The ink jet head 10 discharges ink by applying a driving signal having a certain waveform. Hereinafter, the waveform of the driving signal is referred to as a "driving waveform".

Figure 6:
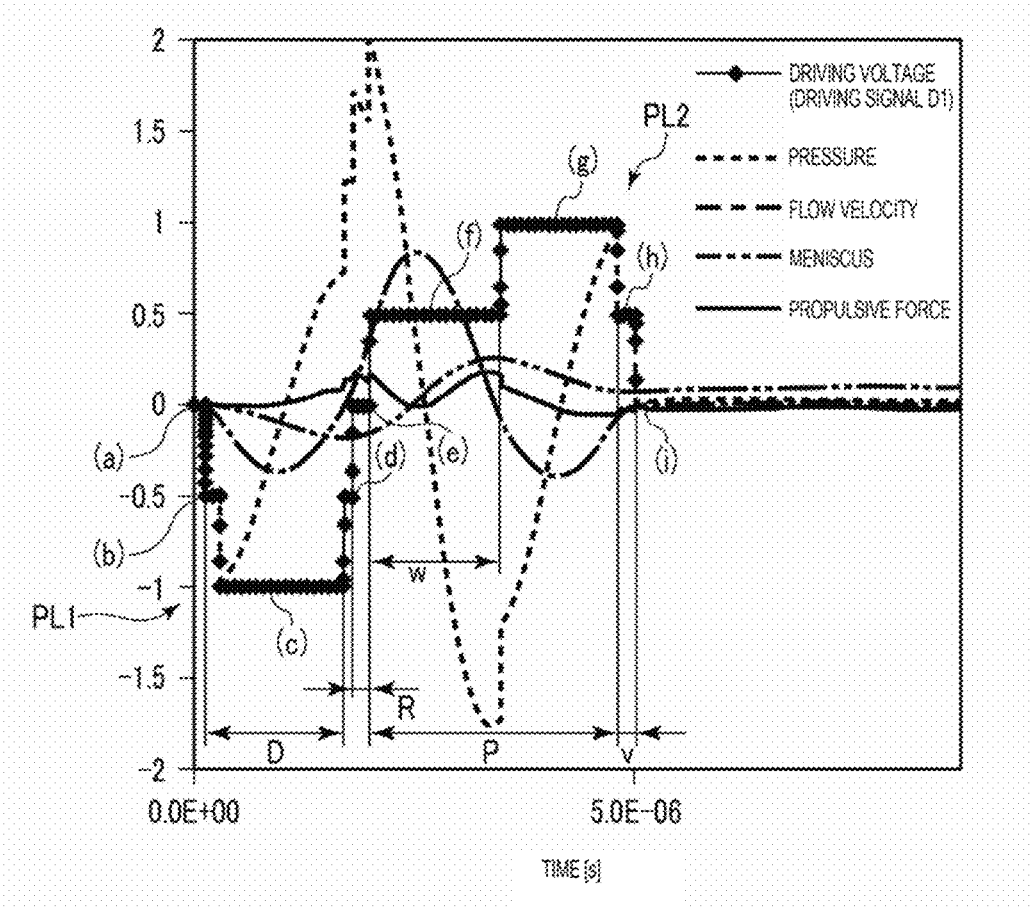
FIG. 6 is a graph illustrating an example of a driving waveform, and an ink pressure, an ink flow velocity, a meniscus, and a propulsive force when this driving waveform is applied to an actuator.

An example of a driving waveform will be described using FIG. 6. FIG. 6 illustrates an example of waveforms of the driving signal D1 which is applied to the actuator by the head driver 100 to discharge ink from the nozzle 25. When the driving signal D1 is applied to the actuator, the ink is discharged from the nozzle 25.

An ink flow velocity ("flow velocity" line) illustrated in FIG. 6 is the velocity of fluid (e.g., ink) on a meniscus surface in the nozzle 25 of the pressure chamber 51. The ink flow velocity is positive when in a vertical direction from a nozzle opening surface (referred to as "nozzle surface") and is set to be negative when in a direction back towards the ink chamber from the nozzle surface. The ink pressure ("pressure" line) illustrated in FIG. 6 is a pressure of the fluid on the meniscus surface in the nozzle 25. The ink pressure has the same +/− directional convention as the flow velocity. The meniscus value ("meniscus" line) illustrated in FIG. 6 indicates a position of the meniscus surface with respect to a reference surface and has the same +/− directional convention as the flow velocity. A driving force value ("propulsive force" line) illustrated in FIG. 6 indicates a force for pushing ink to the meniscus surface and has the same +/− directional convention as the flow velocity.

The driving signal D1 (see "driving voltage" line in FIG. 6) includes a pulse PL1 and a pulse PL2 in sequence.

The pulse PL1 includes a waveform which is changed from a zero potential (a), to a first negative potential (b), to a second negative potential (c), to the first negative potential (d), then to the zero potential (e) in this order. As an example, a magnitude of the first negative potential is a half of a magnitude of the second negative potential.

The pulse PL2 includes a waveform which is changed from the zero potential (e), to a first positive potential (f), to a second positive potential (g), to the first positive potential (h), then to the zero potential (i) in this order. That is, in this example, the pulse PL2 is increased in potential stage by stage (two stages as depicted), and then the potential is reduced stage by stage (two stages as depicted). A magnitude of the first positive potential is a half of a magnitude of a second positive potential.

That is, the driving signal D1 includes overall a waveform which is changed as follows: from the zero potential (a) to the first negative potential (b), to the second negative potential (c), to the first negative potential (d), to the zero potential (e), to the first positive potential (f), to the second positive potential (g), to the first positive potential (h), and then to zero potential (i). Transition from zero potential (e) to the first positive potential (f) represents increase in a first stage. Transition from the first positive potential (f) to the second positive potential (g) represents increase in a second stage. Transition from the second positive potential (g) to the first positive potential (h) represents potential reduction in a first stage. Transition from the first positive potential (h) to the zero potential (i) represents potential reduction in a second stage. The increasing in the first stage is an example of a first potential increase. The increasing in the second stage is an example of a second potential increase. The potential reduction in the first stage is an example of a first potential reduction. The potential reduction in the second stage is an example of a second potential reduction.

The zero potential indicates that a potential difference between a reference potential and the zero potential is within a predetermined range near zero.

The pulse PL1 is an example of a first pulse for driving an actuator so as to reduce the pressure of the pressure chamber. The pulse PL2 is an example of a second pulse for driving the actuator so as to increase the pressure of the pressure chamber.

After the driving signal D1 starts to be applied, the zero potential (a) is applied for a certain time. As an example, the zero potential (a) is applied for 0.12 μseconds. After the zero potential (a), the pulse PL1 starts to be applied. First, the pulse PL1 is changed from the zero potential (a) to the first negative potential (b) and from the first negative potential (b) to the second negative potential (c). After the pulse PL1 becomes the second negative potential (c), the second negative potential (c) is continued until D seconds elapses from the start of the pulse PL1. The pulse PL1 starts to be changed from the second negative potential (c) to the first negative potential (d) and then from the first negative potential (d) to the zero potential (e) after elapsing of D seconds from the start of the pulse PL1.

After the pulse PL1 finishes, and the zero potential (e) is continued for R seconds, the pulse PL2 begins to be applied in the driving signal D1.

The pulse PL2 changes from the zero potential (e) to the first positive potential (f) and then from the first positive potential (f) to the second positive potential (g), then after the first positive potential (f) is continued for w seconds, the pulse PL2 changes from the second positive potential (g) to the first positive potential (h) after the elapse of P seconds from the start of the pulse PL2. The first positive potential (h) is continued for v seconds, then the pulse is changed from the first positive potential (h) to the zero potential (i).

The time D is preferably equal to a half time of a natural vibration period of the pressure chamber 51. The half time of the natural vibration period of the pressure chamber 51 is set to 1 AL (referred to as an "acoustic length"). Therefore, the time D is preferably 1 AL.

The pulse PL2 is preferably applied at a time when the ink pressure is at a maxima. More preferably, the pulse PL2 is applied right after the finish of the pulse PL1. Here, right after the finish of the pulse PL1 means that a time R is approximately zero (0 seconds), though it may be preferable that the time R be slightly greater than zero, for example, equal to the minimum amount of time for which mechanical properties of the ink jet head 10 permits. In the example embodiments described herein, the time R is 0.21.1 seconds.

When the pulse PL2 applied at a time when the ink pressure is at a maxima, a driving voltage can be more reduced than that in the existing related art. Particularly, when the applying of pulse PL2 starts right after the pulse PL1 ends, the driving voltage can be more reduced than that of the related art. Further, when the time R is greater than zero, the driving voltage can be more reduced than that in a case where the time R is exactly zero, that is when there is no time between the end of application of pulse PL1 and start of application of pulse PL2.

When the pulse PL2 is changed from the first positive potential (f) to the second positive potential (g) it is preferable the ink pressure be at a negative value. More preferably, the timing of the change from the first positive potential (f) to the second positive potential (g) corresponds to when the ink pressure is at a negative peak value, so, the residual vibration will be small. When the residual vibration is small, printing quality (e.g., finished image quality) can be expected to be improved.

A time w is preferably 1 AL. When the time w is 1 AL, the residual vibration becomes particularly small.

The time P is preferably 1.3 AL to 1.6 AL so the residual vibration becomes small.

Figure 8:
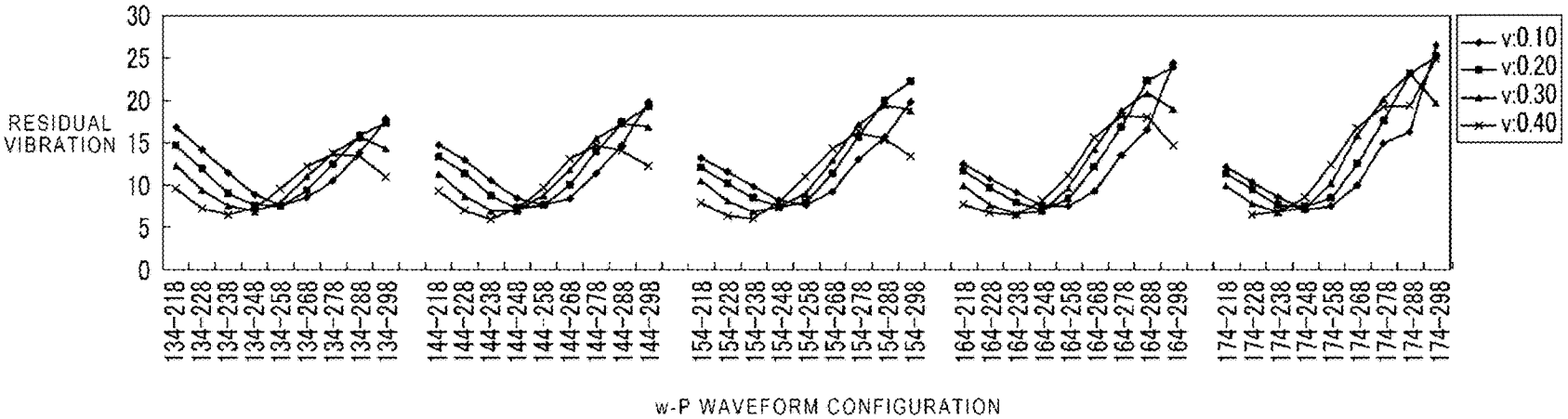
FIG. 8 is a graph illustrating magnitudes of residual vibration when a time w, a time V, and a time P are varied.

FIG. 8 illustrates a magnitude of residual vibration when the time w, time v, and time P are changed. On a horizontal axis of FIG. 8, labels in a XXX-YYY format, such as 134-218 or 134-228, are depicted. This label notation means that the time w value is (XXX×0.01) μseconds and time P value is (YYY×0.01) μseconds. With reference to FIG. 8, it is known that the time P at which the residual vibration becomes minimum is different for each combination of time w and time v. Within the range illustrated in FIG. 8 for combinations of the time w and the time v, it is known that the time P at which the residual vibration becomes minimum is within a range from 2.28 μseconds to 2.58 μseconds.

Figure 9:
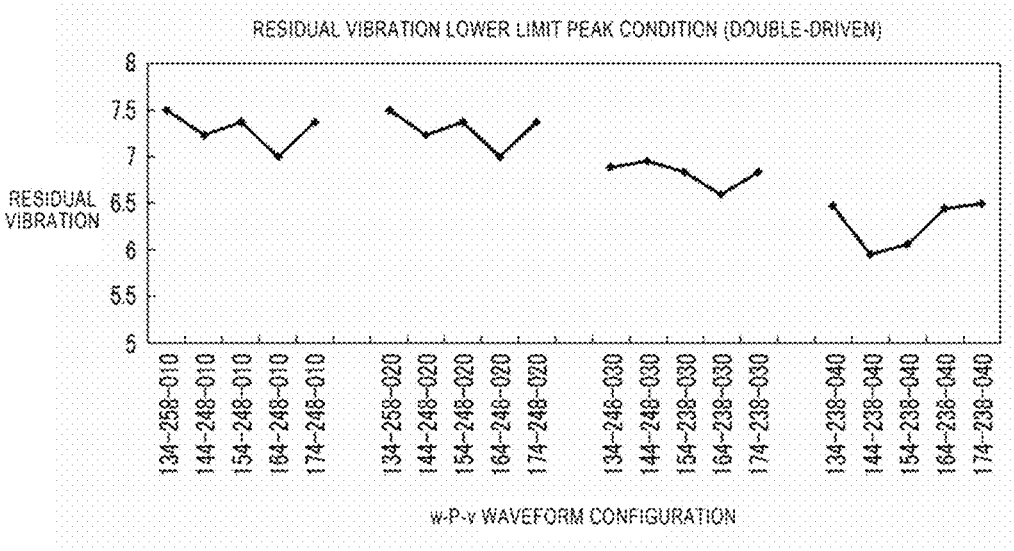
FIG. 9 is a graph illustrating magnitudes of the residual vibration when the time w, the time v, and the time P are varied.

In data illustrated in FIG. 8, data relating to the time P at which the residual vibration becomes minimum can be extracted. The extracted data is illustrated in FIG. 9. On the horizontal axis of FIG. 9, labels in a xxx-yyy-zzz format, such as 134-258-010, are shown. The label format means that the time w value is (xxx×0.01) μseconds, the time P value is (yyy×0.01) μseconds, and the time v value is (zzz×0.01)μ seconds. Further, FIG. 10 illustrates a graph illustrating values of the time P at which the residual vibration becomes smaller when the time v is changed by 0.1 μsecond increments from 0.1 μsecond to 0.4 μseconds when the time w is 1.54 μseconds is extracted from the data illustrated in FIG. 8.

Figure 10:
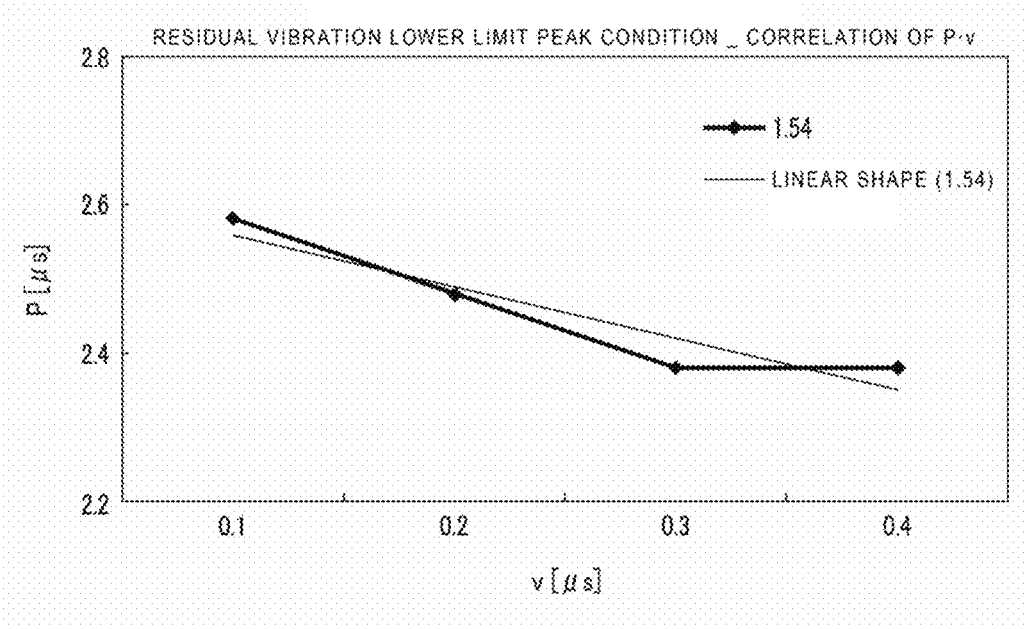
FIG. 10 is a graph illustrating an extracted value of P at which residual vibration becomes the smallest when the time v is changed from 0.1 μsecond to 0.4 μseconds by 0.1 μsecond increments, and the time w is 1.54 μseconds.

With reference to FIGS. 8 to 10, if the time w, the time v, the time P, and the like are selected, it is known that the residual vibration becomes small.

The time v is, for example, the minimum time which can be realized according to mechanical limits of the ink jet head 10. The time v may be longer than this minimum time. If the time v is longer than the minimum time, then time P is preferably shortened in compensation.

With reference to FIG. 10, the time P and the time v preferably satisfy Expression (1) as follows:

$$P=-0.6v+2.63 \qquad \text{Expression (1)}$$

Expression (1) corresponds to the "linear shape (1.54)" line illustrated in FIG. 10. The "linear shape (1.54)" line corresponds to a linear fit of the time P and the time v values depicted in FIG. 10.

When the time P and the time v satisfy Expression (1), the residual vibration becomes small.

The combination of the time P and the time v is preferably chosen such that flow velocity is zero at the end of the pulse PL2.

The 1 AL in the example embodiments described herein is approximately 1.7 μseconds. However, the acoustic length (AL) changes due to physical properties of ink and the like.

Figure 7:
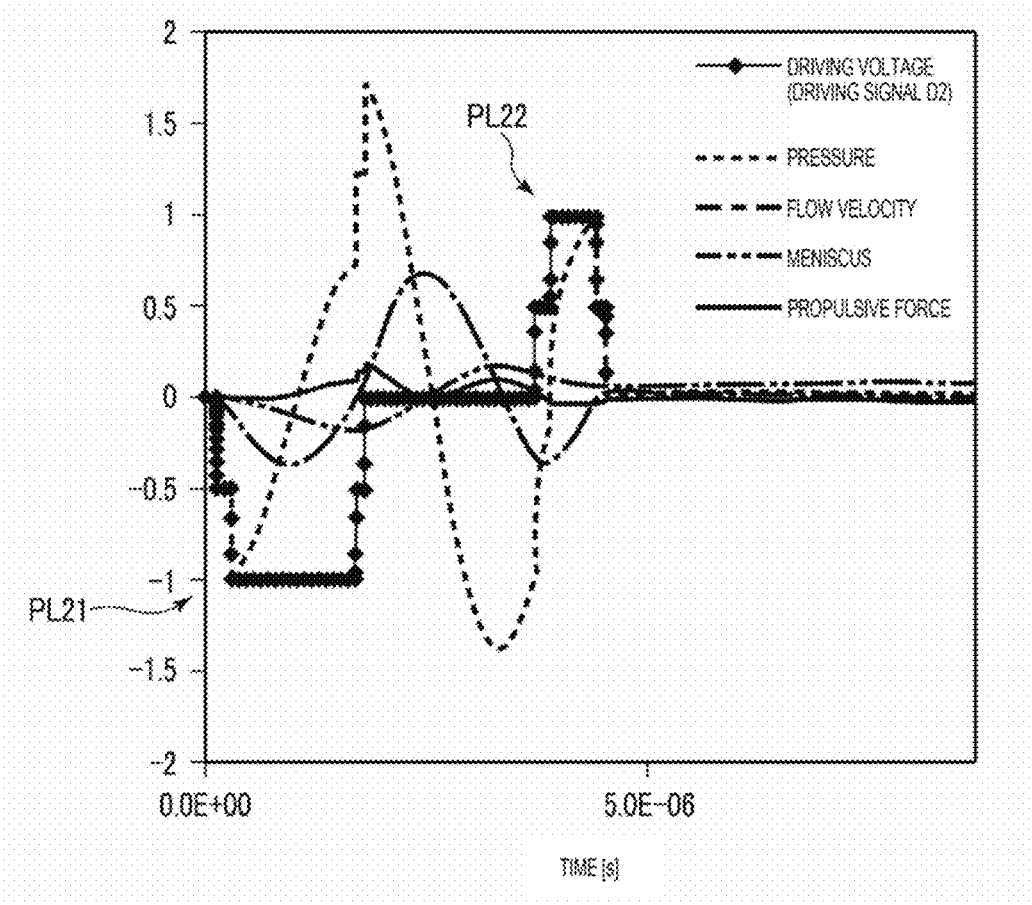
FIG. 7 is a graph illustrating an example of a driving waveform and an ink pressure, an ink flow velocity, a meniscus, and a propulsive force when this driving waveform is applied to an actuator.

With reference to FIGS. 6 and 7, the waveform of the driving signal D1 is compared to a driving waveform from the related art. FIG. 7 is a graph illustrating a driving signal D2 waveform in the related art.

The driving signal D2 includes a pulse PL22 applied once a predetermined time elapses after a pulse PL21 is finished.

The pulse PL21 applies a negative potential and, for example, is applied in the same manner as the pulse PL1 of the driving signal D1 depicted in FIG. 6.

The pulse PL22 applies a positive potential.

As seen from the comparison between FIGS. 6 and 7, a peak height (pressure maximum) of the ink pressure ("pressure" line) in FIG. 6 (for driving signal D1) is greater than a peak height of the ink pressure ("pressure" line) in FIG. 7 (for the driving signal D2). Therefore, even when a voltage of the driving signal D2 is lower than a driving voltage of the driving signal D1, the driving signal D2 can cause the discharging the same manner as the driving signal D1. When the driving voltage of the driving signal D1 and the driving voltage of the driving signal D2 are the same, the driving signal D1 can cause more discharging than the driving signal D2.

Example

Figure 11:
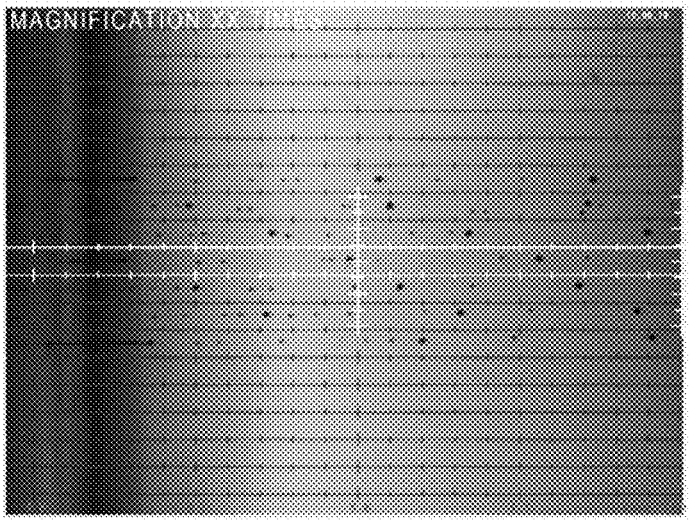
FIG. 11 is a photograph illustrating a flight state of ink according to an example.

As an example, ink is discharged from seven nozzles using the driving signal D1 with the following parameters: D=1 AL, R=0.2 μseconds, w=1 AL, and P=1.3 to 1.6 AL. FIG. 11 is a side view of ink has been discharged from the left side of the image and has flown for some distance. FIG. 11 is a photograph indicating an in-flight state of the ink according to the example. A blackened and darkened part on the left side of FIG. 11 is the ink jet head, and there is one nozzle for each graduation (between row marks) provided so to be a total of seven nozzles. Each nozzle is provided in the middle between the graduation (row marks). The ink is discharged from the seven nozzles and travels from the left side towards the right side. Black dots in FIG. 11 represent ink that is traveling. Printing density is high when the ink travels close to the middle of the respective rows or travel lanes between the gradations (row marks).

Comparative Example

Figure 12:
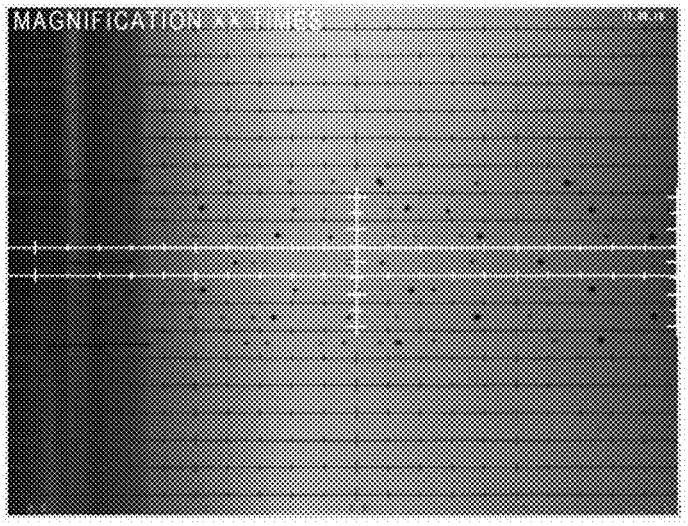
FIG. 12 is a photograph illustrating a flight state of ink according to a comparative example.

In a comparative example, depicted in FIG. 12, the ink is discharged in the same manner as that of FIG. 11 excepting that the driving signal D2 is used instead of the driving signal D1. The driving voltage in the example described above is lower than the driving voltage in the comparative example described herein. FIG. 12 is a side view of ink has been discharged from the left side of the image and has flown for some distance according to the comparative example.

When FIGS. 11 and 12 are compared to each other, a substantial difference is not seen. Therefore, it can be seen that the printing density in the example embodiment is not substantially different from the comparative example.

Accordingly, the same or substantially similar printing density can be obtained by use of driving signal D1 but with use of power that is less than required with driving signal D2.

The example embodiments described above can be modified as follows.

In the example embodiments described above, the pulse PL2 was divided into two stages and increases stage by stage. However, the pulse PL2 may be divided into three stages or more and increase stage by stage. In this case, two stages selected from stages respectively correspond to the first potential increase and the second potential increase. In the example embodiments described above, the pulse PL2 is divided into two stages and is reduced stage by stage, but the pulse PL2 may be divided into three stages or more and reduced stage by stage. In this case, two stages selected from the stages respectively correspond to the first stage of the finish and the second stage of the finish.

In the example embodiments described above, the driving element 18 is a shear mode-deformed element. However, the driving element 18 may be deformed other than in shear mode deformation.

In some embodiments, the ink jet head 10 may have a structure in which a vibration plate is deformed due to electricity (e.g., piezoelectricity) so as to discharge ink, a structure in which ink is discharged using heat energy such as a heater, or the like. In this case, the vibration plate, the heater, or the like, is an actuator for supplying pressure-vibration into the pressure chamber 51.

The ink jet recording apparatus 1 is an ink jet printer which forms a two-dimensional image using ink on an image forming medium. S (see FIG. 1). However, the inkjet recording apparatus 1 is not limited thereto. The ink jet recording apparatus 1 may be, for example, a 3D printer, an industrial manufacturing machine, a medical machine, or the like. When the ink jet recording apparatus 1 is a 3D printer or the like, the ink jet recording apparatus 1 discharges, for example, a binder for solidifying a substance from the ink jet head to form a three-dimensional object.

The ink jet recording apparatus 1 includes four fluid discharging units 2, and ink I used for each of the fluid discharging units 2 is cyan, magenta, yellow, or black. However, the number of the fluid discharging units 2 included in the ink jet recording apparatus is not limited four and may not be plural. A color and properties of the ink I used for each of the fluid discharging units 2 are not limited. The fluid discharging units 2 are capable of discharging transparent gloss ink, ink being developed when infrared rays or ultraviolet rays are applied thereto, other special inks, or the like. In general, the composition of the ink is not a limitation in the present disclosure. Furthermore, the fluid discharging unit 2 may be a unit capable of discharging fluids other than ink. Fluid being discharged by the fluid discharging unit 2 may be a dispersion such as suspension. As fluid other than ink discharged by the fluid discharging unit 2, for example, there are fluids including electrical conductive particles for forming a wiring pattern of a printed wiring substrate (e.g., printed circuit board), fluid including cells for forming artificial cells, organs, or the like, a binder such as an adhesive, wax, viscose resin, or the like.

Each numerical value described above is intended to include errors within a reasonable range within the scope and spirit of the present disclosure.

While certain embodiments have been described, these embodiments have been presented by way of example only, and are not intended to limit the scope of the present disclosure. Indeed, the novel embodiments described herein may be embodied in a variety of other forms. Furthermore, various omissions, substitutions and changes in the form of the embodiments described herein may be made without departing from the spirit of the disclosure. The accompanying claims and their equivalents are intended to cover such forms or modifications as would fall within the scope and spirit of the present disclosure.

What is claimed is:

1. A waveform generating device, comprising:

a head driver configured to apply a driving signal to an actuator to discharge ink from a pressure chamber connected to a nozzle, the driving signal including a first portion for reducing an ink pressure in the pressure chamber and a second portion for increasing the ink pressure in the pressure chamber, wherein the second portion is increased in potential by a first potential increase when ink pressure in the pressure chamber is at a maxima, and the second portion is further increased in potential by a second potential increase when the ink pressure of the pressure chamber is at a negative value after the first potential increase.

2. The waveform generating device according to claim 1, wherein the second portion is reduced in potential in a first stage by a first potential reduction and then again in a second stage by a second potential reduction.

3. The waveform generating device according to claim 2, wherein, when a time from a start of the second portion to the first potential reduction is set to P, and a time from the first potential reduction to the second potential reduction is set to v, the driving signal satisfies the following:

$$P=-0.6v+2.63.$$

4. The waveform generating device according to claim 1, wherein the driving signal includes applying a zero potential for an interval between an end of the first portion and a start of the second portion.

5. The waveform generating device according to claim 1, wherein the pressure chamber is fluidly connected to an ink chamber, and a time length of the first portion is equal to a half time of a natural vibration period of ink in the ink chamber.

6. The waveform generating device according to claim 5, wherein the second portion is increased in potential by the second potential increase after a time equal to the half time of the natural vibration period elapses after the second potential increase.

7. The waveform generating device according to claim 5, wherein the second portion is reduced in potential by a first potential reduction after between 1.3 times and 1.6 times the half time of the natural vibration period of the ink in the ink chamber from a start of the second portion.

8. An ink jet recording apparatus, comprising:

a nozzle plate having a nozzle;

an actuator configured to change a pressure of a pressure chamber connected to the nozzle; and a head driver configured to apply a driving signal to an actuator to discharge ink from the pressure chamber connected to the nozzle, the driving signal including a first portion for reducing an ink pressure in the pressure chamber and a second portion for increasing the ink pressure in the pressure chamber, wherein the second portion is increased in potential by a first potential increase when ink pressure in the pressure chamber is at a maxima, and the second portion is further increased in potential by a second potential increase when the ink pressure of the pressure chamber is at a negative value after the first potential increase.

9. The ink jet recording apparatus according to claim 8, wherein the second portion is reduced in potential in a first stage by a first potential reduction and then again in a second stage by a second potential reduction.

10. The ink jet recording apparatus according to claim 9, wherein, when a time from a start of the second portion to the first potential reduction is set to P, and a time from the first potential reduction to the second potential reduction is set to v, the driving signal satisfies the following:

$$P=-0.6v+2.63.$$

11. The ink jet recording apparatus according to claim 8, wherein the driving signal includes applying a zero potential for an interval between an end of the first portion and a start of the second portion.

12. The ink jet recording apparatus according to claim 8, wherein the pressure chamber is fluidly connected to an ink chamber, and a time length of the first portion is equal to a half time of a natural vibration period of ink in the ink chamber.

13. The ink jet recording apparatus according to claim 12, wherein the second portion is increased in potential by the second potential increase after a time equal to the half time of the natural vibration period elapses after the second potential increase.

14. The ink jet recording apparatus according to claim 12, wherein the second portion is reduced in potential by a first potential reduction after between 1.3 times and 1.6 times the half time of the natural vibration period of the ink in the ink chamber from a start of the second portion.

15. An inkjet head driving method, comprising:

applying a driving signal to an actuator to discharge ink from a pressure chamber connected to a nozzle, the driving signal including a first portion for reducing an ink pressure in the pressure chamber and a second portion for increasing the ink pressure in the pressure chamber, wherein the second portion is increased in potential by a first potential increase when ink pressure in the pressure chamber is at a maxima, and the second portion is further increased in potential by a second potential increase when the ink pressure of the pressure chamber is at a negative value after the first potential increase.

16. The inkjet head driving method according to claim 15, wherein the second portion is reduced in potential in a first stage by a first potential reduction and then again in a second stage by a second potential reduction.

17. The inkjet head driving method according to claim 16, wherein, when a time from a start of the second portion to the first potential reduction is set to P, and a time from the first potential reduction to the second potential reduction is set to v, the driving signal satisfies the following:

$$P=-0.6v+2.63.$$

18. The inkjet head driving method according to claim 15, wherein the driving signal includes applying a zero potential for an interval between an end of the first portion and a start of the second portion.

19. The inkjet head driving method according to claim 15, wherein the pressure chamber is fluidly connected to an ink chamber, and a time length of the first portion is equal to a half time of a natural vibration period of ink in the ink chamber.

20. The inkjet head driving method according to claim 19, wherein the second portion is increased in potential by the second potential increase after a time equal to the half time of the natural vibration period elapses after the second potential increase.

* * * * *